United States Patent [19]

Wilson

[11] 4,185,707

[45] Jan. 29, 1980

[54] AUGER CONSTRUCTION

[76] Inventor: Alvin K. Wilson, 89900 Demming Rd., Elmira, Oreg. 97437

[21] Appl. No.: 894,683

[22] Filed: Apr. 10, 1978

Related U.S. Application Data

[63] Continuation of Ser. No. 712,841, Aug. 9, 1976, abandoned.

[51] Int. Cl.[2] ..... E02D 17/14; E21B 9/04; E21C 1/14

[52] U.S. Cl. ..... 175/394; 175/410; 299/87

[58] Field of Search ..... 175/394, 395, 323, 410, 175/411; 198/676, 677; 37/81, 82; 299/87

[56] References Cited

U.S. PATENT DOCUMENTS

| | | | |
|---|---|---|---|
| 2,863,640 | 12/1958 | Petersen | 175/394 |
| 3,140,748 | 7/1964 | Engle et al. | 175/410 |
| 3,202,228 | 8/1965 | Schuster | 175/394 |
| 3,422,915 | 1/1969 | Watts | 175/394 |
| 3,710,877 | 1/1973 | Michasiw | 175/394 X |
| 3,937,317 | 2/1976 | Fleury, Jr. | 198/676 |
| 4,074,780 | 2/1978 | Gilbert | 175/394 |

*Primary Examiner*—William Pate, III
*Attorney, Agent, or Firm*—James D. Givnan, Jr.

[57] ABSTRACT

An auger is disclosed having flighting outer edges protected by overlying, wear resistant bits applied in a continuous manner. The leading edge of the flighting is protected by wear resistant bits applied along the edge. A point carries ribs of hard material such as carbide, the edge of which constitutes a cutting edge. The bits are applied with solder.

1 Claim, 7 Drawing Figures

AUGER CONSTRUCTION

BACKGROUND OF THE INVENTION

The present application is a continuation of my copending United States Patent Application bearing the same title filed Aug. 9, 1976 under Ser. No. 712,841.

The present invention relates generally to augers for boring ground holes and particularly to such an auger having wear resistant material applied to edge surfaces.

Augers used in the formation of small ground holes for tree planting in mountainous areas are susceptible to rapid wear by reason of forceful contact with sand, rock, etc., which wear necessitates the refurbishment of the auger at recurring intervals. In order for an operator to maintain a continuous operation, a supply of augers must be on hand which represents a costly inventory. Further, when operating at remote locations a logistics problem is encountered. Another drawback to refurbishing worn augers is the high cost of repair work.

Within known prior art are various types of augers with hardened bits or teeth attached to the auger by various mounting arrangements to enhance auger operation. For the most part, the hardened bits or cutter teeth are secured to auger flights in a removable manner for purposes of periodic replacement. On small diameter augers, 3 to 4 inches in diameter, the attachment of bit holders represents a difficult task and when accomplished provides no protection for exposed flight edges. Additionally, the cost of mounting bit holders to a flight and the bits supported therein is prohibitive.

SUMMARY OF THE PRESENT INVENTION

The present invention is embodied within an auger having flight peripheral edges protected by a series of continuous members such as carbide bits secured to said edges in a permanent manner.

The present auger comprises a shaft about which extends helical flighting the outer edge of which is protected by bits of wear resistant material. The lower or leading edge of flighting is protected against wear by superposed wear resistant bits secured to and projected forwardly to provide a leading substantially planar surface. Adjacent the lower end of the auger shaft is a horizontal plate which restricts ground penetration of the auger to a desired rate which plate is also protected from the action of earthen matter by wear resistant material. The lower end of the auger shaft carries a replaceable point which includes circumferentially spaced ribs of wear resistant material which protect the point from excessive wear.

Important objectives of the present auger construction include the provision of an auger having flighting with wear resistant bits of material permanently mounted on the auger at points of excessive wear such as the flighting helical outer edge and the flighting leading edge; the provision of an auger wherein the leading edge of the flighting is protected by superposed wear resistant carbide bits which are manufactured and used primarily heretofore in saws and which bits are economically available in both cuboidal and trapezoidal shapes the latter novelly used on an auger leading edge: to jointly provide an inclined, leading surface the provision of an auger having a penetration controlling plate also protected from wear by wear resistant segments, and: the provision of an auger having rapidly wearing surfaces protected by the application of carbide tips individually secured in place on the flighting outer edge by solder or the like.

DETAILED DESCRIPTION OF THE PREFERRED EMBODIMENT

Figures 1, 2, 3, 4, 5, 6, 7:
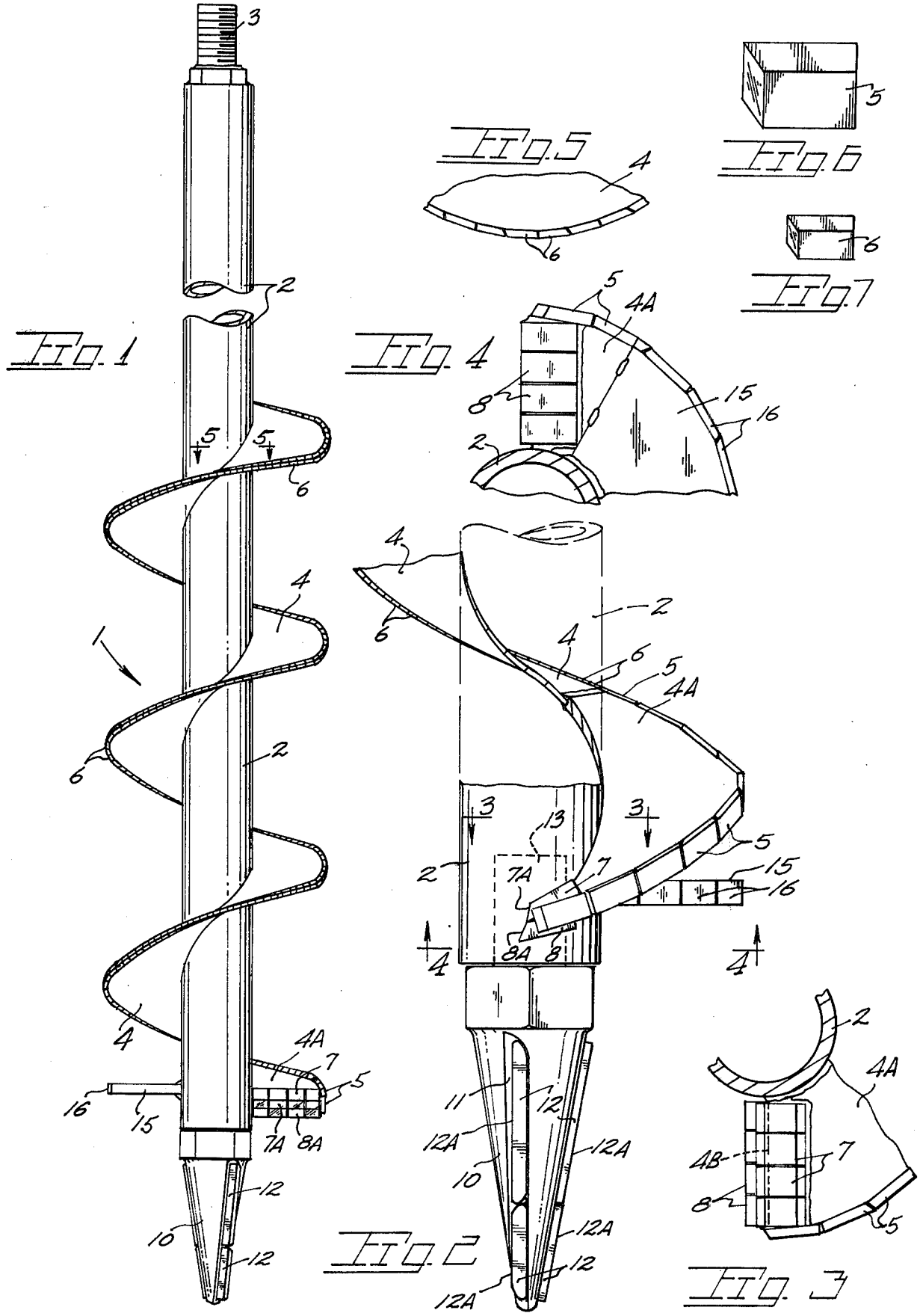
FIG. 1 is an elevational view of the present auger.
FIG. 2 is an enlarged elevational view of the lower end of the auger viewed in FIG. 1 rotated through ninety degrees.
FIG. 3 is a sectional view taken downwardly along line 3—3 of FIG. 2 and showing leading edge construction of the present auger.
FIG. 4 is a sectional view taken upwardly along line 4—4 of FIG. 2 showing the underside of leading edge and a penetration control plate.
FIG. 5 is an enlarged fragmentary view of an auger flight having a protective edge.
FIGS. 6 and 7 are enlarged plan veiw of metallic bits utilized for auger application.

With continuing reference to the accompanying drawing wherein the reference numeral 1 indicates generally an auger made in accordance with the present invention. The auger includes an auger shaft 2 which may be tubular and fitted at its upper end with a stud 3, or other drive engaging component, for driven engagement with a power source. In the auger illustrated the flight diameter is approximately four inches (101.6 mm) with the auger adapted for coupling to a portable power source such as a small gasoline engine. Obviously, the invention is not limited to auger size or uses.

Indicated at 4 is auger flighting which is of helical configuration and secured along its inner edge to the shaft. With attention to lower portion of the flighting, said portion includes a helical segment 4A (FIG. 3). Segment 4A is of greater thickness than the remaining flighting and is protected against abrasion by metallic carbide bits. Edge mounted bits of cuboidal shape at 5 overlay the outer edge or peripheral wall or edge of helical segment 4A. Additional cuboidal bits at 6, of somewhat smaller dimensions, are of a size to overlay the edge or peripheral wall of remaining flighting 4 which, as above noted, is of lesser gauge than segment 4A. As seen in FIG. 5, the bits 6 have some abutting edges tangential to the auger shaft axis.

Mounted above and below the leading edge 4B of the flighting segment 4A are additional bits of hard metal material such as those of carbide. These latter bits are trapezoidal and are superposed in upper and lower rows at 7 and 8 and thereby protect the softer metal leading edge 4B from abrading contact with the material being penetrated. The bits used in rows 7 and 8 are generally of trapezoidal configuration with rearwardly inclined upper and lower frontal surfaces at 7A—8A which permits their joint formation of an elongate, substantially planar cutting surface when applied along flighting leading edge 4B.

For securement of the bits to the flighting, I utilize silver solder applied initially to the bit which is thereafter heated while held in place for solder securement. Other solder types may be adequate, however the above mentioned solder has proved very adequate.

In FIGS. 1 and 2, a conical auger point is indicated at 10 which is milled at 11 to provide lengthwise extending grooves within which are secured hard metal bits 12 such as those of carbide. The bits may be of elongate shape to extend the length of the recess with a bit edge 12A radially offset from the conical surface to protect the latter from abrasive contact. Again bit attachment may be by silver solder. For point attachment a stud 13 extends upwardly from the point into threaded engagement with an internally secured nut element 14.

To control the rate of penetration of the auger, a horizontal control plate 15 of semi-circular shape, is mounted normal to the axis of the auger shaft. The forward or leading portion (during auger operation) of the control plate terminates in merged securement to the underside of auger segment 4A. The outer edge of the control plate is also desirably protected with cuboidal bits 16 secured in place contiguously along its arcuate edge of solder.

With attention to FIGS. 3, 4, and 5 it will be seen that the earlier mentioned canted end surface of the bits provide increased surface area between adjacent bits to enhance bit securement.

The augers constructed in accordance with the present invention have those surfaces normally exposed to severe abrasion and hence rapid wear, fully protected. Accordingly auger maintenance and replacement are greatly reduced providing the operator substantial cost savings as well as a significant reduction in equipment down time.

While I have shown but one embodiment of the invention it will be apparent to those skilled in the art that the invention may be embodied still otherwise without departing from the spirit and scope of the claimed invention.

Having thus described the invention what is desired to be secured under a Letters Patent is claimed:

1. In an auger for the forming of small diameter ground holes in rocky ground for the planting of tree seedlings, said auger having a central shaft and helical flighting, the improvement comprising, a semicurcular control plate on said shaft disposed normally to the shaft axis adjacent the shaft lower end to inhibit auger penetration and having an outer edge, carbide bits contiguously secured to said outer edge, said helical flighting terminating in a leading edge, said semicurcular control plate intersecting the flighting, upper and lower superposed rows of carbide bits secured to said flighting leading edge, the last mentioned carbide bits being of trapezoidal shape and each having a rearwardly inclined frontal surface which jointly conprise an elongate substantially planar rearwardly inclined cutting surface to provide a long wearing protective leading surface for the auger flighting, and said helical flighting having carbide bits secured to the flighting peripheral wall in a contiguous manner to protect said wall from abrasion.

* * * * *